US009667016B2

(12) United States Patent
Tamai

(10) Patent No.: US 9,667,016 B2
(45) Date of Patent: May 30, 2017

(54) CONNECTING BLADE, METHOD OF PRODUCING CONNECTING BLADE, AND ELECTRICAL CONNECTOR INCLUDING CONNECTING BLADE

(71) Applicant: Hirose Electric Co., Ltd., Tokyo (JP)

(72) Inventor: Nobuhiro Tamai, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/041,110

(22) Filed: Feb. 11, 2016

(65) Prior Publication Data

US 2016/0240976 A1 Aug. 18, 2016

(30) Foreign Application Priority Data

Feb. 18, 2015 (JP) ..... 2015-029413

(51) Int. Cl.

| | |
|---|---|
| ***H01R 13/6476*** | (2011.01) |
| ***H01R 43/24*** | (2006.01) |
| ***H01R 13/6467*** | (2011.01) |
| *H01R 43/16* | (2006.01) |
| *H01R 13/6587* | (2011.01) |

(52) U.S. Cl.

CPC ..... *H01R 43/24* (2013.01); *H01R 13/6467* (2013.01); *H01R 13/6587* (2013.01); *H01R 43/16* (2013.01)

(58) Field of Classification Search

CPC ..... H01R 13/6477; H01R 13/6476; H01R 13/6469; H01R 13/6467; H01R 13/6473; H01R 13/6461; H01R 23/005; H01R 23/025; H01R 43/16

USPC ..... 439/941, 885

See application file for complete search history.

(56) References Cited

U.S. PATENT DOCUMENTS

| | | | | |
|---|---|---|---|---|
| 4,021,095 A * | 5/1977 | Kinkaid | H01R 43/00 | 206/717 |
| 6,146,202 A * | 11/2000 | Ramey | H01R 12/585 | 439/607.1 |
| 7,182,643 B2 * | 2/2007 | Winings | H01R 29/00 | 439/607.39 |
| 8,313,354 B2 * | 11/2012 | McAlonis | H01R 12/722 | 439/198 |

(Continued)

FOREIGN PATENT DOCUMENTS

JP 2013-080648 A 5/2013

*Primary Examiner* — Gary Paumen

(74) *Attorney, Agent, or Firm* — Kubotera & Associates, LLC

(57) ABSTRACT

A connecting blade includes an insulation board having an adjustment region; and paired differential lines disposed on the insulation board. Each of the paired differential lines has contact points at both ends thereof for connecting to a circuit connecting member. The paired differential lines include a straight pair and a cross pair. The straight pair is formed of two first lines not crossing each other. The cross pair is formed of two second lines having a crossing region where the two second lines cross each other without contacting with each other. The cross pair is arranged so that the cross pair contacts with the adjustment region at least partially. The adjustment region has a specific size and a permittivity so that a signal transmission time lag between the cross pair and the straight pair is reduced.

7 Claims, 9 Drawing Sheets

(56) References Cited

U.S. PATENT DOCUMENTS

| | | | | |
|---|---|---|---|---|
| 8,357,013 | B2 * | 1/2013 | Arai | H04M 1/76 379/417 |
| 8,961,232 | B2 * | 2/2015 | Wang | H01R 13/719 439/620.01 |
| 2009/0011655 | A1 * | 1/2009 | Amleshi | H01R 13/6471 439/668 |
| 2010/0184307 | A1 | 7/2010 | Arai et al. | |
| 2012/0188025 | A1 * | 7/2012 | Wu | H05K 1/0227 333/12 |
| 2013/0273777 | A1 * | 10/2013 | Wang | H01R 13/719 439/620.01 |

* cited by examiner

CONNECTING BLADE, METHOD OF PRODUCING CONNECTING BLADE, AND ELECTRICAL CONNECTOR INCLUDING CONNECTING BLADE

BACKGROUND OF THE INVENTION AND RELATED ART STATEMENT

The present invention relates to a connecting blade for connecting two electrical connectors, a method of producing the connecting blade, and an electrical connector having the connecting blade.

Patent Reference 1 has disclosed a conventional connecting blade that connects two electrical connectors. In order to achieve high-speed signal transmission and noise reduction, a paired differential line is found to be effective, in which two transmission lines is paired. In the conventional connecting blade disclosed in Patent Reference 1, when a plurality of paired differential lines is formed on the conventional connecting blade, the paired differential lines may be formed of a straight pair and a cross pair arranged alternately, so as to reduce crosstalk between adjacent paired differential lines. In this case, it is necessary to improve electrical characteristics through reducing a signal transmission time lag (a skew) between the straight pair and the cross pair. For this reason, in the conventional connecting blade disclosed in Patent Reference 1, in order to reduce the skew, the straight pair is provided with a wave-shaped section over a substantially entire length thereof, so that the straight pair is formed to have a line length same as that of the cross pair.

However, when elements (lines) that compose the straight pairs and the cross pairs are formed through punching a sheet metal, it is difficult to use a common die for the straight pairs and the cross pairs even partially. For this reason, it is necessary to prepare special dies respectively for the straight pairs and the cross pairs, which have different shapes over the whole lengths thereof. Furthermore, in order to form the straight pairs with the wave-shaped sections, it is necessary to prepare a punching die having a complicated wave shape.

Patent Reference 2 has disclosed a conventional connecting blade having a different configuration. In the conventional connecting blade disclosed in Patent Reference 2, the cross pair has a parallel region, where the lines of the cross pair are parallel to each other except a crossing region of the cross pair. Further, the straight pair has a quasi-crossing region, which has a shape the same as that of the crossing region of the cross pair viewed from a direction perpendicular to a plate surface of an insulation board. The straight pair also has a parallel region, where the lines of the straight pair are parallel to each other except the quasi-crossing region of the straight pair. Accordingly, the straight pair has the same line length as that of the cross pair.

In the conventional connecting blade disclosed in Patent Reference 2, the quasi-crossing region of the straight pair is defined as a region corresponding to the crossing region of the cross pair other than the parallel region. In the quasi-crossing region, two lines of the straight pair are arranged not to cross, or are arranged close enough but not to cross but to look like as if the two lines cross as compared with the parallel region, when viewed in the direction perpendicular to the plate surface of the insulation board.

Patent Reference 1; U.S. Patent Application Publication No. 2010/0184307

Patent Reference 2; Japanese Patent Application Publication No. 2013-080648

As described above, the conventional connecting blade disclosed in Patent Reference 2 is configured so as to solve the problems of the conventional connecting blade disclosed in Patent Reference 1. However, the straight pair is provided with the quasi-crossing region, which is supposed to be straight. Accordingly, the straight pair tends to have a complicated shape, thereby increasing a cost of a die thereof. Furthermore, when even a slight change is made in a shape or a dimension of the quasi-crossing region of the straight pair, the change may affect the whole shape of the straight pair and the punching die. Accordingly, after the shape of the straight pair is finalized, if it is found to be difficult to completely eliminate the signal transmission time lag, it is difficult to change the whole shape of the die.

In view of the above-described problems, an object of the present invention is to provide a connecting blade capable of easily reducing the skew between a straight pair and a cross pair thereof, while the straight pair maintains a straight shape without being formed in a complicated shape such as a quasi-crossing region. Further, another object of the present invention is to provide a method of producing the connecting blade. A further object of the present invention is to provide an electrical connector having the connecting blade.

In the present invention, when it is found to be difficult to eliminate the signal transmission time lag after a shape of the cross pair is finalized, it is necessary to change only a part of a molding die for molding integrally with an insulating board thereof without changing the punching die. As a result, it is possible to provide the connecting blade, which is easily adjustable in comparison with a change required in the conventional technique, the producing method of producing the connecting blade, and the electrical connector having the connecting blade.

SUMMARY OF THE INVENTION

In order to attain the objects described above, according to a first aspect of the present invention, a connecting blade includes paired differential lines for differential transmission, which are held on an insulation board. Each of the paired differential lines has contact points at both ends thereof to connect two circuit connecting members. The paired differential lines include straight pairs and cross pairs, which are juxtaposed on the insulation board. Each of the straight pairs is composed of two of the differential lines that do not cross each other. Each of the cross pairs is composed of two of the differential lines that cross but without contacting each other at middle positions of the lines and have crossing regions including cross points.

According to the first aspect of the present invention, in the connecting blade, the cross pairs contact with adjustment regions of the insulation board, which face at least a part of the whole length of the lines of the cross pairs and are formed with lower permittivity than that of the insulation board. The range and permittivity of the adjustment regions are selected so as to reduce signal transmission time lags between the cross pairs and the straight pairs.

According to the first aspect of the present invention, in the connecting blade having the above-described configuration, the straight pairs can remain straight. In addition, it is not necessary to provide such wave-shaped areas as that of the configuration disclosed in Patent Reference 1 or such quasi-crossing regions as that of the configuration disclosed in Patent Reference 2. As a result, the lines can have very simple shapes. Therefore, the die for die-cutting work can have a simple shape, which results in lower manufacturing cost.

According to the first aspect of the present invention, in the connecting blade having the above-described configuration, the cross pairs partially contact with the adjustment regions having lower permittivity than that of the insulation board, so that it is achievable to eliminate the signal transmission time lags from the straight pairs. As described above, the signal transmission time lags can be easily adjusted through adjusting the cross pairs, more specifically, through adjusting a portion of the cross pairs that contacts with, for example, the insulation board that supports the cross pairs, rather than through changing the cross pairs by themselves. Moreover, for this purpose, as described above, it is achievable to keep the straight shapes of the straight pairs.

According to the first aspect of the present invention, the adjustment regions are formed making a portion of the insulation board that supports the cross pairs to have lower permittivity than that of the insulation board and contact with the cross pairs. For example, such part of the insulation board may be made as an air layer. Alternatively, such part of the insulation board may be formed of other insulating material having lower permittivity than that of the insulation board.

According to the first aspect of the present invention, when re-adjustment is necessary after setting the adjustment regions once, it is not necessary to change the punching die for the cross pairs as well as the one for the straight pairs. Such re-adjustment is achievable by having only a part of the integral molding die for the insulation board, which corresponds to the adjustment regions, be replaceable and changeable so as to change the size of the adjustment regions.

According to the present invention, the adjustment regions may be concave portions or holes, which are formed in the insulation board so as to expose a part of the cross pairs, and inside of the concave portions or the holes can be air layers. The adjustment regions may be adjusted by changing the exposed range of the cross pairs at the concave portions or the holes.

According to the present invention, the adjustment regions may be formed on the crossing regions of the cross pairs.

According to a second aspect of the present invention, a method of producing a connecting blade is provided. The connecting blade includes paired differential lines for differential transmission, which are held on an insulation board. Each of the paired differential lines has contact points at both ends to connect two circuit connecting members. The paired differential lines include straight pairs and cross pairs, which are juxtaposed on the insulation board. Each of the straight pairs is composed of two of the differential lines that do not cross each other. Each of the cross pairs is composed of two of the differential lines that cross but without contacting each other at middle positions of the lines and have crossing regions including cross points.

According to the second aspect of the present invention, in the method of producing a connecting blade, a first material and a second material are prepared. The first material includes line materials for one lines of the cross pairs and both lines of the straight pairs, which are connected with carriers. The second material includes the other lines of the cross pairs, which are connected with carriers. Then, the other line materials of the second material are separated from the carriers, and are disposed in positions so as to form the crossing regions with the one line materials of the first material. Then, the other line materials are attached to the carriers of the first material. Thereafter, adjustment regions having lower permittivity than that of the insulation board are formed at least a part of the whole lengths of the lines of the cross pairs, so that the both line materials of the cross pairs and the both line materials of the straight pairs are held by the insulation board through integral molding with the insulation board. Thereafter, the carriers are cut and removed.

According to the second aspect of the present invention, the first material having the line materials of the straight pairs and the one line materials of the cross pairs, and the second material having the other line materials of the cross pairs are separately prepared. Therefore, as for the second material, the other line materials can be formed at tight pitch for punching, so that it is achievable to reduce waste and improve the yield.

According to the second aspect of the present invention, the adjustment regions are concave portions or holes formed on the insulation board so as to expose a part of the cross pairs. Inside of the concave portions or holes may be used as space for a part of the die to hold the line materials of the cross pairs upon integral molding with the insulation board. As a result, it is achievable to form air layers in the concave portions or the holes after removing the die.

According to a third aspect of the present invention, it is achievable to provide an electrical connector, which includes a plurality of the above-described connecting blades and a housing that holds the connecting blades at certain intervals. The housing is opened at both end sides, where contact points of the connecting blades are located. Mating connectors can fit to the housing so as to connect to the connecting blades at their contact points. According to this aspect of the present invention, it is achievable to connect a connector connected on a circuit board to another connector connected on another circuit board via the connector of the present invention by connecting the mating connectors to the contact points provided on the both ends of the connecting blades. Accordingly, the connector having the connecting blades of the present invention can serve as an intermediate connector to connect one circuit board to another circuit board.

According to the present invention, it is achievable to provide a connecting blade, in which paired differential lines, straight pairs and cross pairs, are held by the insulation board, and its manufacturing method. According to the present invention, it is also possible to provide an electrical connector that includes the electrical blades. In the electrical connector, the cross pairs contact with the adjustment regions, which face at least a part of the whole length of the lines of the cross pairs and are made of a material having lower permittivity than that of the insulation board. Here, the range and the permittivity of the adjustment regions are selected so as to reduce the signal transmission time lags between the cross pairs and the straight pairs.

Therefore, it is achievable to keep the straight pairs straight, and to provide the adjustment regions that contact with the cross pairs without changing the cross pairs themselves. Furthermore, it is also achievable to reduce to eliminate the signal transmission time lags from the straight pairs with simple shapes and easy method. In addition, even after setting the shapes, it is achievable to re-set only by changing the adjustment regions. As a result, not only the straight pairs, but also the cross pairs can be formed with a punching die having a simple shape. Since it is necessary to change only a part of the molding die for integral molding with the insulation board, the molding die can be also simplified and thereby the manufacturing cost can be reduced.

BRIEF DESCRIPTION OF THE DRAWINGS

FIGS. 2(A) through 2(C) are views showing one of the connecting blades used in the connector of FIG. 1, wherein FIG. 2(A) is a perspective view of the connecting blade, FIG. 2(B) is a perspective view of arranged state of straight pair, cross pair, and grounding line materials, which are prior to integral molding of the connecting blade of FIG. 2(A) with an insulating board of the connecting blade, and FIG. 2(C) is a front view of a left half portion of the connecting blade of FIG. 2(A);

FIGS. 3(A) through 3(D) are perspective views, wherein FIG. 3(A) is the view of one straight pair of FIG. 2(B), FIG. 3(B) is the view of one cross pair of FIG. 2(B), and FIG. 3(C) is the view of one grounding line material of FIG. 2(B), and FIG. 3(D) is an enlarged view of a crossed area of the cross pair of FIG. 3(B);

FIGS. 4(A) and 4(B) are front views showing a first material and a second material to make the connecting blade of FIGS. 2(A) through 2(C), wherein FIG. 4(A) is the front view of the first material and FIG. 4(B) is the front view of the second material;

DETAILED DESCRIPTION OF THE PREFERRED EMBODIMENTS

Hereunder, an embodiment of the present invention will be described with reference to the accompanying drawings.

Figure 1:
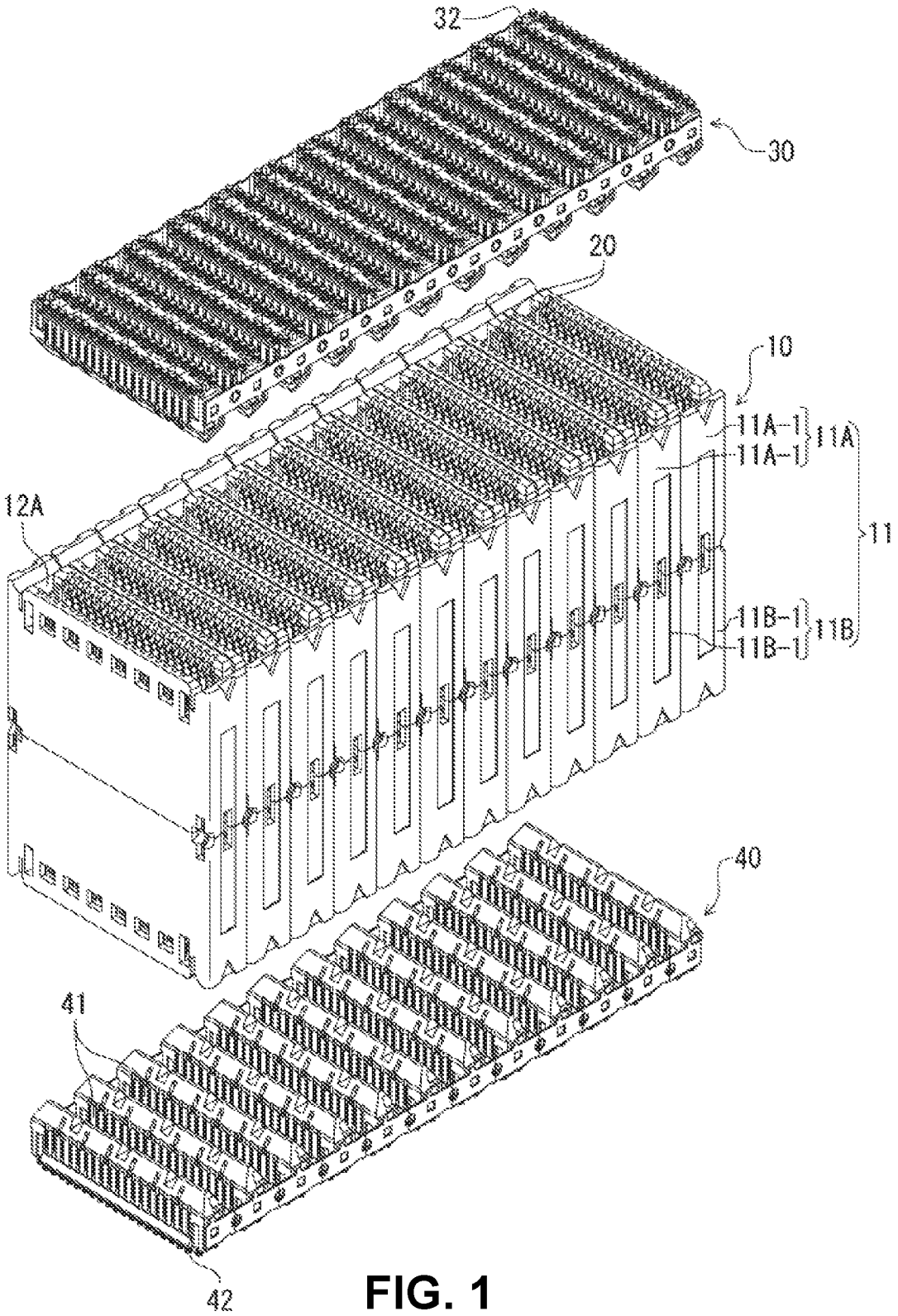
FIG. 1 is a perspective view showing an outer appearance of an electrical connector as an intermediate connector having connecting blades and two mating connectors to connect to the electrical connector according to a first embodiment of the present invention.

FIG. 1 is a perspective view of an intermediate electrical connector 10 and two mating connectors 30 and 40 before connecting them. The intermediate electrical connector 10 includes a plurality of connecting blades 20, which are held by an insulating holding body 11. The mating connectors 30 and 40 are circuit connecting members and are connected to the electrical connector 10.

As shown in FIG. 1, the intermediate electrical connector 10 includes a connecting blade group that consists of a plurality of connecting blades 20, and an insulating holding body 11. The insulated holding body 11 is formed as a rectangular piped housing and includes an upper holding body 11A and a lower holding body 11B. The plurality of the connecting blades 10 is positioned in an up-and-down direction and is held by the upper holding body 11A and the lower holding body 11B, such that sheet surfaces of the connecting blades 20 are parallel to each other. Each of the upper holding body 11A and the lower holding body 11B is formed by joining a plurality of block bodies 11A-1. In each of the block bodies 11A-1, there is formed a holding hole 12A (holding holes 12B of the lower holding bodies 11B are not illustrated in FIG. 1). The holding holes 12A are formed to penetrate in the up-and-down direction so as to accommodate and hold one connecting blade 20.

In the insulating holding body 11, which is composed of the upper holding body 11A and the lower holding body 11B, the holding holes 12A and 12B of the respective block bodies 11A-1 and 11B-1 are open in the up-and-down direction. With those holding holes 12A and 12B, the insulating holding body 11 can fit and receive fitting portions of mating connectors 30 and 40. As a result, terminals (contact portions) of the connectors 30 and 40 contact and connect to contact points of the connecting blades 20. The mating connector 30 and the mating connector 40 are made to have substantially a same shape. In FIG. 1, the mating connectors 30 and 40 are facing each other, with one of the mating connector 30 or 40 is flipped upside down.

On the other hand, each of the mating connectors 30 and 40 has slit openings 41 (slit openings 31 of the mating connector 30 direct downward and not shown in the figure) for the number of the block bodies of the upper insulated holding bodies 11, which form the connecting blade group 20. On the other surface of the mating connectors 30 and 40, there are provided soldering balls 32 and 42 attached to the terminals. The mating connectors 30 and 40 are to be soldered onto respective corresponding circuit parts (not illustrated) with the soldering balls 32 and 42. Accordingly, the mating connectors 30 and 40 are respectively attached to corresponding circuit boards, and while facing each other as shown in FIG. 1, the mating connectors 30 and 40 are connected via the intermediate electrical connector 10.

Figure 2:
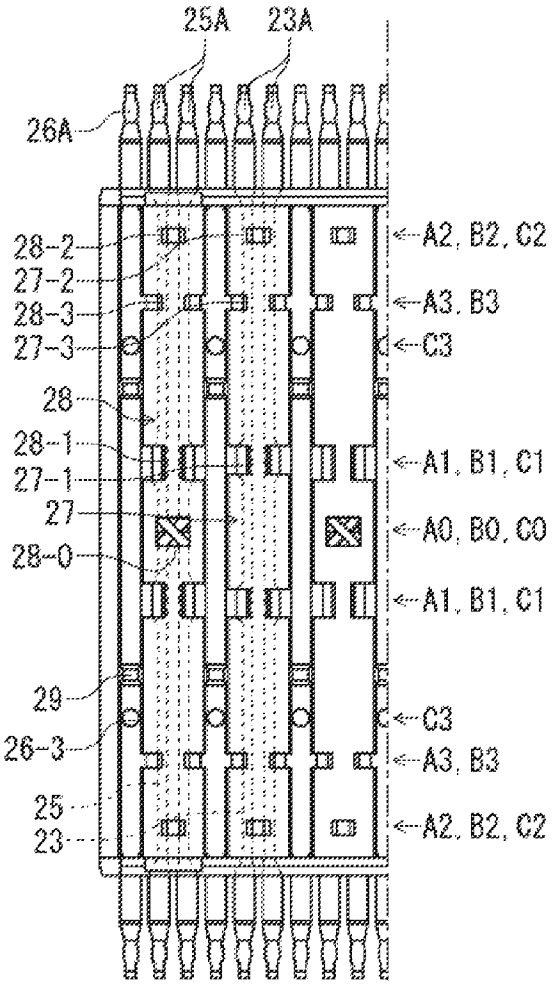
Figure 2:
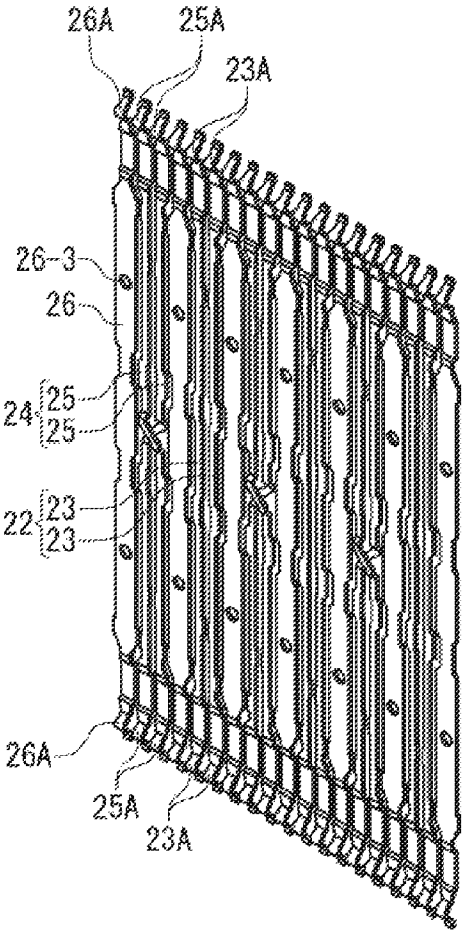
Figure 2:
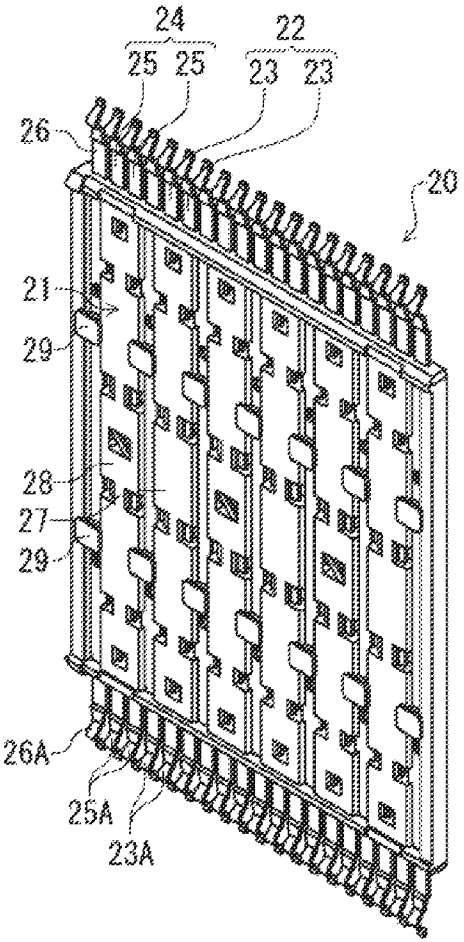

As shown in FIGS. 2(A) and 2(B), in which the insulation board 21 is omitted from the illustration, the connecting blades 20 include pairs of lines 23, another pairs of lines 25, and grounding lines 26. The lines 23 and 25 are signal lines. Each pair of the lines 23 is formed as a straight pair and each pair of the lines 25 is formed as a cross pair 24. The straight pairs 22, the cross pairs 24, and the grounding lines 26 are held on an insulating board 21 by integral molding. The insulation board 21 is made of an electrically insulating material.

The straight pairs 22 and the cross pairs 24, which are paired differential lines for signals, and the grounding lines 26 are made, for example, by punching sheet metal into strips and partially bending the strips. As shown in FIG. 2(B), on the insulation board 21, the straight pairs 22, the cross pairs 24, and the grounding lines 26 are repeatedly arranged in the order. Any of the lines of the straight pairs 22, the cross pairs 24, and the grounding lines 26 extend up to the both edges (upper and lower ends in FIG. 2(B)) of the insulating board 21. The lines of the straight pairs 22, the cross pairs 24, and the grounding lines 26 have contact points 23A, 25A, and 26A, respectively on their both ends.

Figure 3:
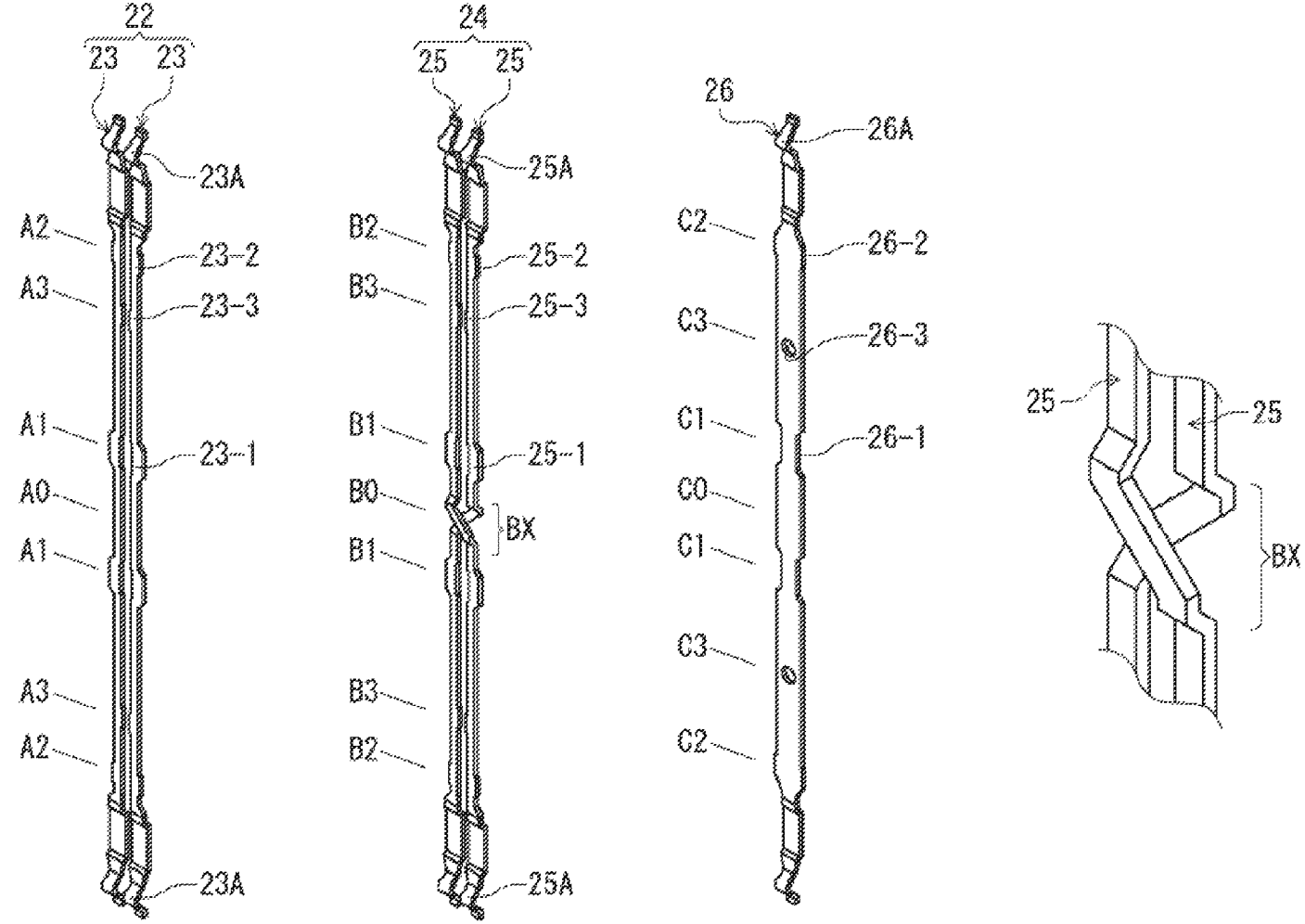

As shown in FIG. 3(A), the lines 23 of each pair, which forms the straight pair 22, is laterally and vertically symmetrical to each other. As already described, each of the lines 23 has contact points 23A at their ends. At positions A1 near the center A0 in the longitudinal (up-and-down direction), two positions A2 near the ends, which are close to the contact points 23A, intermediate positions A3, which are provided between the positions A1 and the positions A2, there are formed wide portions 23-1, 23-2, and 23-3, where side edges slightly protrude. Between the contact points 23A, the width of the line 23 stays substantially the same, and the line is straight.

As shown in FIG. 3(A), when a pair of lines 23 is arranged as a straight pair 22, the wide portions 23-1 and 23-2 are located outside in the width direction, but the wide portions 23-3 are located inside.

Next, the lines 25 of each cross pair 24 has contact points 25A at their both ends. As shown in FIG. 3(B), the respective positions in the longitudinal direction of the blades in a cross pair 24 are indicated by affixing "B" instead of "A" in the straight pair, A0 through A3. Here, for the respective positions of the grounding lines 26 are indicated by affixing "C" instead of "A" in the positions of the straight pair 22. As shown in FIG. 3(B), except the center position B0 in the longitudinal direction and the crossing region BX near the center portion B0, a pair of lines that forms a cross pair 24 has similar shape to that of the lines 23 of the straight pair 22. One line 25 and the other line 25 are bent in a direction to be away from each other in the sheet thickness direction at the crossing region BX, and the lines 25 cross each other without contacting (enlarged view of the crossing region BX is shown in FIG. 3(D)).

The wide portions 25-1, 25-2, and 25-3 at the center position B0, positions B1 near the center, positions B2 near the ends, and intermediate positions B3 between B1 and B2 are formed similarly to those of the lines 23 of the straight pairs 22.

As shown in FIG. 3(C), each of the grounding lines 26 has contact points 26A at its both ends and is formed as a wider strip than the lines 23 of the straight pairs 22 and the lines 25 of the cross pairs 24. Each of the grounding lines 26 has a narrow portion 26-1 at positions C1 both sides of the center C0 and wide portions 26-2 at positions C2 near the ends in the longitudinal direction. In the grounding lines 26, intermediate positions C3 are provided between C1 and C2, being closer to the center position C0 than the intermediate positions A3 in the straight pair and the intermediate positions B3 in the cross pairs 24. At the intermediate positions C3, there are formed connection holes 26-3 for connecting with a grounding plate, which is not illustrated in the figure.

As described above, the lines 23 of the straight pairs 22, the lines 25 of the cross pairs 24, and the grounding lines 26 are formed as shown in FIGS. 3(A), 3(B), and 3(C). Being arranged as shown in FIG. 2(B), the straight pairs 22, the cross pairs 24, and the grounding lines 26 are integrally molded onto an insulating material such as resin and held by the insulation board 21 as shown in FIG. 2(A). As a result, a connecting blade is formed as a whole.

As shown in FIG. 2(A), in the connecting blade 20, the contact points 23A, the contact points 25A, and the contact points 26A protrude from the both upper and lower edges of the insulation board 21. As already described, the contact points 23A are provided on the both ends of the lines 23 of the straight pair 22. The contact points 25A are provided on both ends of each of the lines 25 of the cross pairs 24. The contact points 26A are provided at both ends of each of the grounding lines 26.

As shown in FIGS. 2(A) and 2(C), the insulation board 21 holds the straight pairs 22 and the cross pairs 24 by embedding most part of the lines 23 and 25 of the straight pairs 22 and the cross pairs 24 in the two plate surfaces except the contact points 23A and 25A, which protrude and are exposed from the insulation board 21. The insulation board 21 holds the grounding lines 26 by partially embedding side edges of the grounding lines 26 in the insulation board 21, but exposing most part of the surfaces, so as to hold the grounding lines 26 only at the side edges. The grounding lines 26 have narrow portions 26-1 at the positions C1 as shown in FIG. 3(C), so that the narrow portions 26-1 are not held by the insulation board 21.

As described above, according to the embodiment, the straight pairs 22 and the cross pairs 24 are held by the insulation board 21 in the connecting blade 20, and grounding plates (not illustrated) are attached to both front and back surfaces of the connecting blade 20. On the other hand, on the grounding plate (for example, the grounding plate on the front side), there are formed ribs that contact with exposed parts of the grounding lines 26, and the ribs are held by protrusions 29. The protrusions 29 are formed on the insulation board 21, and will be described later. On the other grounding plate (the one provided on the back side in FIGS. 2(A) and 2(C)), there are formed protrusions that rise from the sheet surface, so as to penetrate the connecting holes 26-3 of the grounding lines 26 and contact with the other grounding plate.

In the embedding strips 27 that covers the straight pairs 22 and the embedding strips 28 that cover the cross pairs 24, as shown in FIGS. 2(A) and 2(C), there are formed notched portions and window-like opening at a plurality of positions in the longitudinal direction (in the up-and-down direction in FIGS. 2(A) and 2(C)). Those notched portions and window-like portions are formed as a result of pulling a pressing part of a die, which presses and supports the straight pairs 22 and the cross pairs 24 upon molding of the insulation board 21, after the molding.

First, at the side edges of each of the embedding strips 27, which covers the straight pair 22, long notches 27-1 and short notches 27-3 are formed at positions corresponding to the positions A1 near the center of the straight pair 22 and the intermediate positions A-3, respectively. In the center in a width direction of the embedding strip 27, window-like openings 27-2 are formed at positions corresponding to the positions A2.

At the positions A1, A2, and A3, wide portions 23-1, 23-2, and 23-3 of the line 23 of the straight pair 22 are provided. The pressing part of the die will press the very small side edge part, which is equivalent to enlarged widths of the wide portions 23-1, 23-2, and 23-3, upon molding.

Therefore, as for the wide portions 23-1, 23-2, and 23-3, even after pulling the die after molding, the straight pairs 22 are embedded in the insulation board 21 in most part except the contact points 23A. Next, on the side edges of each of the embedding strip 28 that covers the cross pair 24, there are formed long notches 28-1 and short notches 28-3 at positions corresponding to the positions B1 and the intermediate positions B3, respectively. In the center in the width direction of the embedding strip 28, there are formed window-like openings 28-2 at positions corresponding to the positions B2.

At the positions B1, B2, and B3, there are provided the wide portions 25-1, 25-2, and 25-3 of the lines 25 of the cross pairs 24, respectively. The pressing part of the die will press very small side edge parts, which are equivalent to the widen part of the wide portions 25-1, 25-2, and 25-3, upon molding. Therefore, as for the wide portions 25-1, 25-2, and 25-3, even after pulling out the die after finishing the molding, the cross pairs 24 are embedded in the insulation board 21 in most part except the contact points 23A.

In the embedding strips 28 that cover the cross pairs 24, there are formed window-like adjustment regions 28-0 that expose the crossing regions Bx located at the center B0 of the cross pairs 24. The crossing regions BX of the cross pairs 24 are exposed at the window-like adjustment regions 28-0. Accordingly, within the range of the adjustment regions 28-0, there are formed air layers where there is no insulating material in the insulation board 21 that supports the cross pairs 24.

Furthermore, while the straight pairs 22 do not have such adjustment regions 28-0, in the cross pairs 24, even if the lines 25 are longer than the lines 23 of the straight pairs 22 at the crossing regions BX, the permittivity of the air layer is lower than that of the insulation board, so that the signal transmission speed is higher for that amount. Therefore, it is achievable to reduce the signal transmission time lag from the straight pairs 22, and also to eliminate the signal transmission time lag by setting the size of the adjustment regions 28-0. Such window-like adjustment regions 28-0 may be formed by disposing the pressing part of the molding die, similarly to the notches 28-1 and 28-3 and the window-like portions 28-2.

Each of the grounding lines 26 has protrusions 29, which protrude in the sheet thickness direction, at two locations in the longitudinal direction near the connection holes 26-3. Those protrusions 29 are formed as short rectangular parallelepipeds that protrude in a direction perpendicular to the paper surface in FIG. 2(C), while being in a state that the grounding plate (not illustrated) is attached.

After fitting the protrusions 29 to the corresponding holes of the grounding plate to attach the grounding plate, the protrusions 29 are crushed and spread while being in melted state, so as to be flat sheet and secure the grounding plate as if they are rivets. Accordingly, the grounding lines 26 are embedded in the insulation board only at very narrow parts where the protrusions 29 are present. Here, the secured grounding plate is omitted in FIG. 2(A).

Next, a method of producing such connecting blade will be described. First, a first material M (see FIG. 4(A)) and a second material N (see FIG. 4(B)) are prepared by punching sheet metal. In the first material M, parts to become the lines 23 of the straight pairs 22, one lines 25 of the cross pairs 24, and the grounding lines 25 are joined and held via carriers C1. In the second material N, parts to become the other lines 25 of the cross pairs 24 are joined and held via the carriers C2.

Here, the respective parts of the first material M are indicated by affixing "M" before the reference numerals, for example, the part to be the straight pair 22 is indicated with "M22" and the part to become the line 23 is indicated with "M23". Similarly, the respective parts of the second material N are indicated by affixing "N" before the reference numerals, for example, the lines to become the other lines 25 of the cross pairs 24 are indicated with "N25". With this indication, it is easier to identify if the part is before or after the connecting blade is formed.

Figure 4:
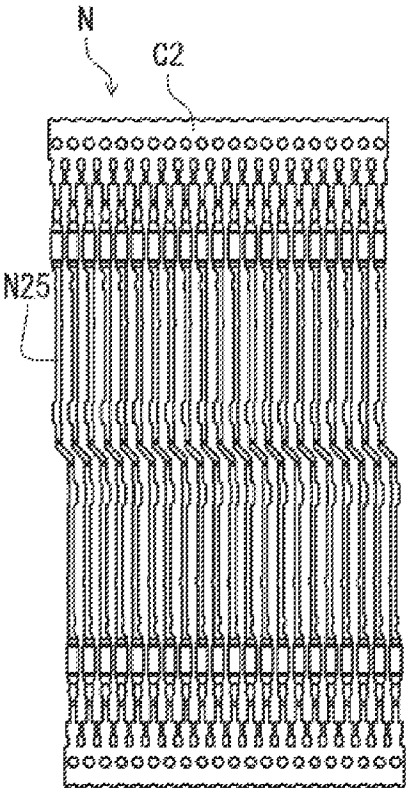
Figure 4:
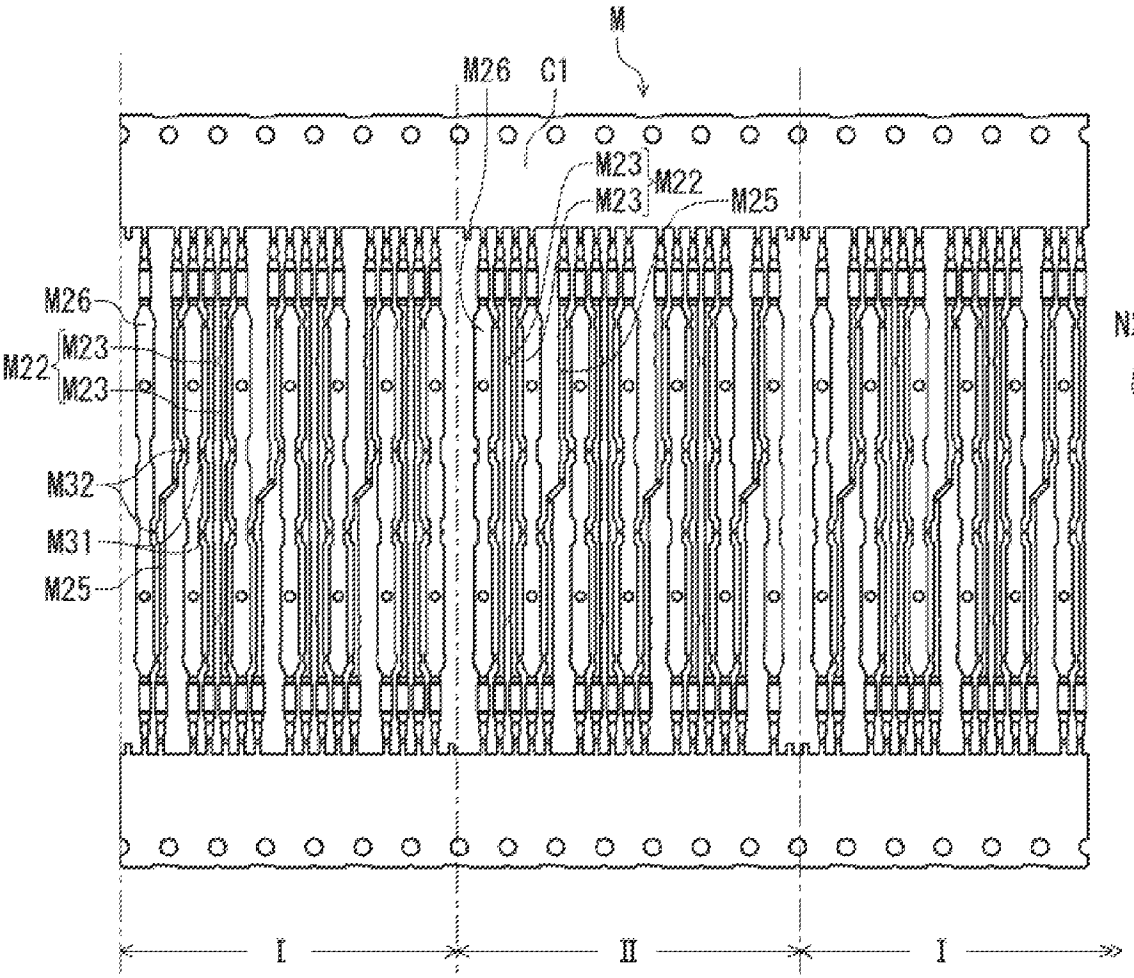

As shown in FIG. 4(A), the first material M has two types of sections, Section I and Section II, which are alternately arranged. Section I and Section II differ in how the respective parts are arranged. In Section I, in the arrangement order shown in FIGS. 2(A) and 2(B), the grounding line material part M26, one line material part M25 of the cross pair part M24, the grounding line material part M26, and a pair of line material part M23 of the straight pair part M22 are arranged in the order from the left side. After repeating the arrangement three times, the grounding line material part M26 is disposed on the right end.

Section II has the same arrangement as Section I but being rotated 180 degrees in the paper surface. One section has respective parts for the number required for one connecting blade. In other words, Section I and Section II may be provided for one connecting blade by cutting the carrier C1 after molding the insulation board 21. Between Section I and Section II, there is one blank part where there is no line material part provided.

Such blank part is provided in each Section, such that the one line material part M25 and a pair of line material parts M23 are alternately provided. After cutting at the carrier C1, forming the connecting blade and then rotating Section II for 180 degrees as described above, Section II has the same arrangement as Section I and forms the connecting blade of the same configuration.

Therefore, in the first material M having the above-described arrangement pattern, the material is effectively used while minimizing the blank part. As shown in FIG. 4(A), in the first material M, the grounding line material part M26, the straight pair material part M22, and one line material part M25 of the cross pair are joined at two points with joining portions M31 and M32. Those joining portions M31 and M32 are for keeping the respective line material parts in positions until the integral molding with the insulation board is completed. After molding, the joining portions M31 and M32 will be cut as will be described later and the respective line material parts are not connected to each other.

On the other hand, in the second material N, only the other line material parts of the cross pair are continuously arranged and held with the carrier C2. In the second material N, since only the line material parts N25 are tightly arranged, there is no blank part between sections such as the one in the first material M.

Figure 5:
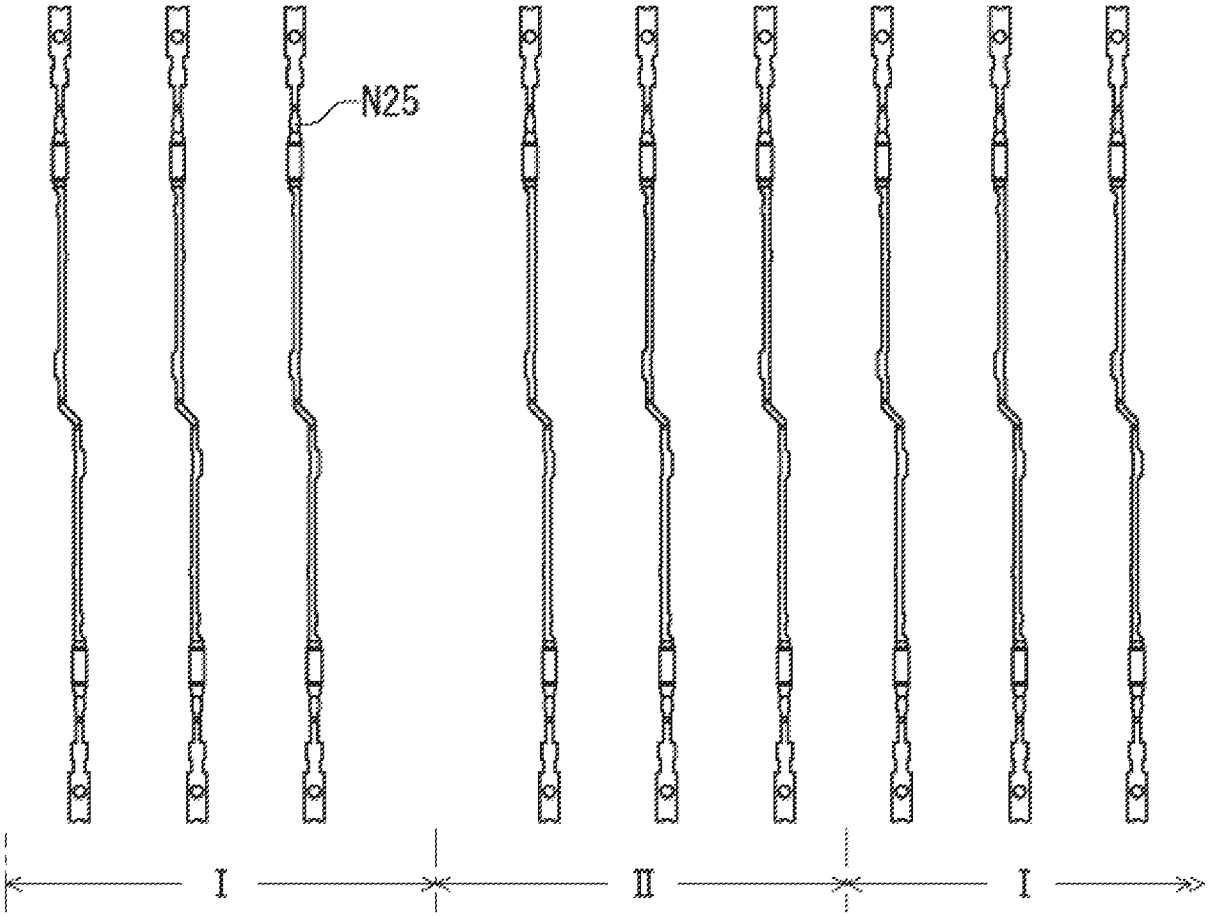
FIG. 5 is a front view showing the other line materials of the cross pairs, which are separated from the second material.

Upon making the connecting blade, the first material M is composed of parts that are divided with dot-and-dash lines in FIG. 4(A). In case of the second material N, the carrier C2 is cut to separate the respective line material parts N25 as shown in FIG. 5. For one section of the first material N, the line material parts N25 after cutting from the second material N are used for the number of the other line material parts M25 of the cross pairs in one section of the first material.

Preparing such first material M and second material N, the connecting blades will be made as described below.

(1) Prepare the first material M as shown in FIG. 4(A). Cut at the carrier C2 as shown in FIG. 5 so as to separate the respective line material parts N25 of the second material N of FIG. 4(B). Here, in FIG. 5, the line material parts N25 are shown at positions corresponding to the sections I and II of the first material M.

Figure 6:
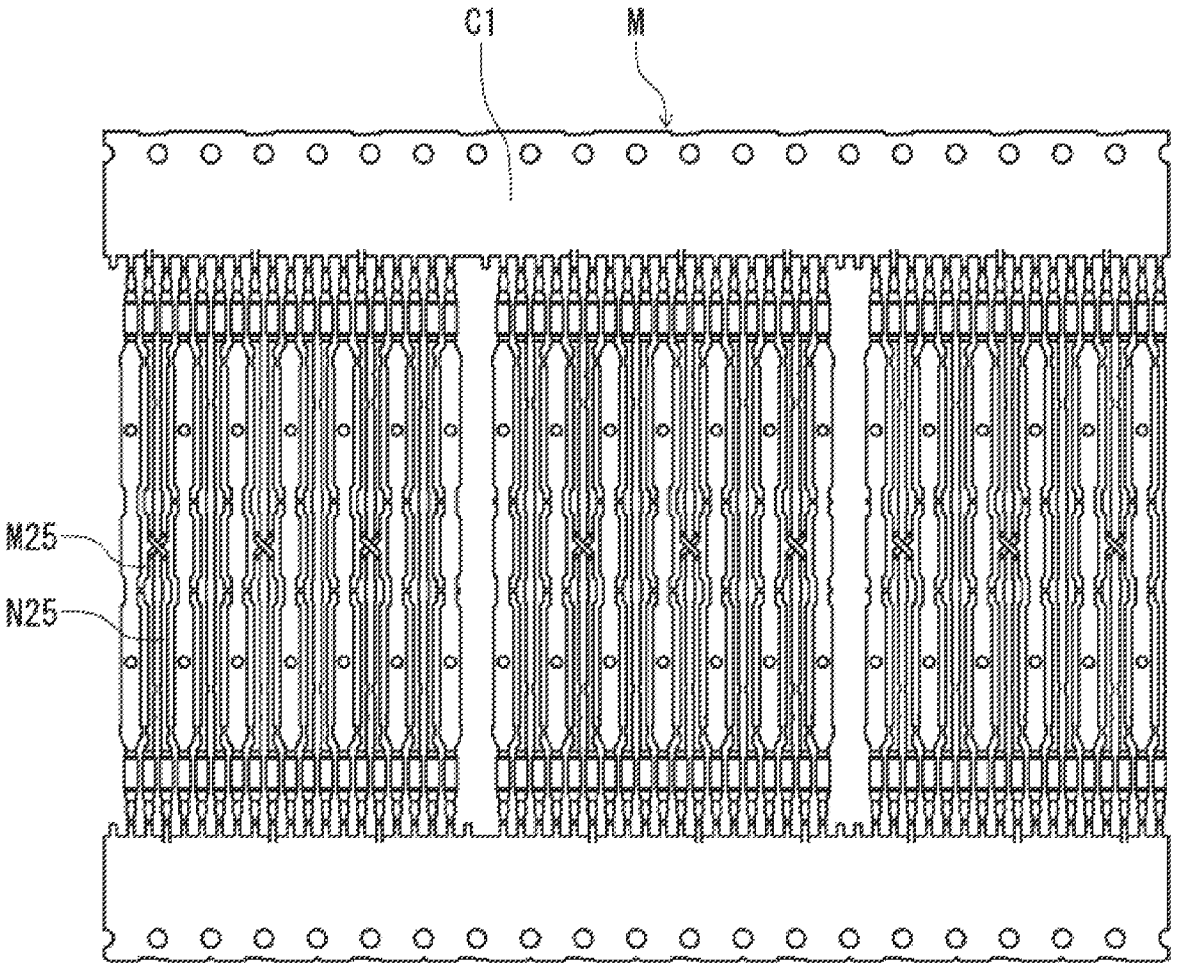
FIG. 6 is a front view showing a state the other line materials of FIG. 5 separated from the second material are arranged and attached on the first material.

(2) Arrange the respective line material parts N25, which are cut to separate from the second material N, with the one line material parts M25 of the cross pairs in the sections I and II of the first material M as shown in FIG. 6, so as to form the crossing regions BX at the center positions B0 as shown in FIG. 3(B). The arranged line material parts N25 are attached to the carrier C1 of the first material M at their ends by suitable method, such as melting and swaging, and secured in the positions as shown in FIG. 6.

Figure 7:
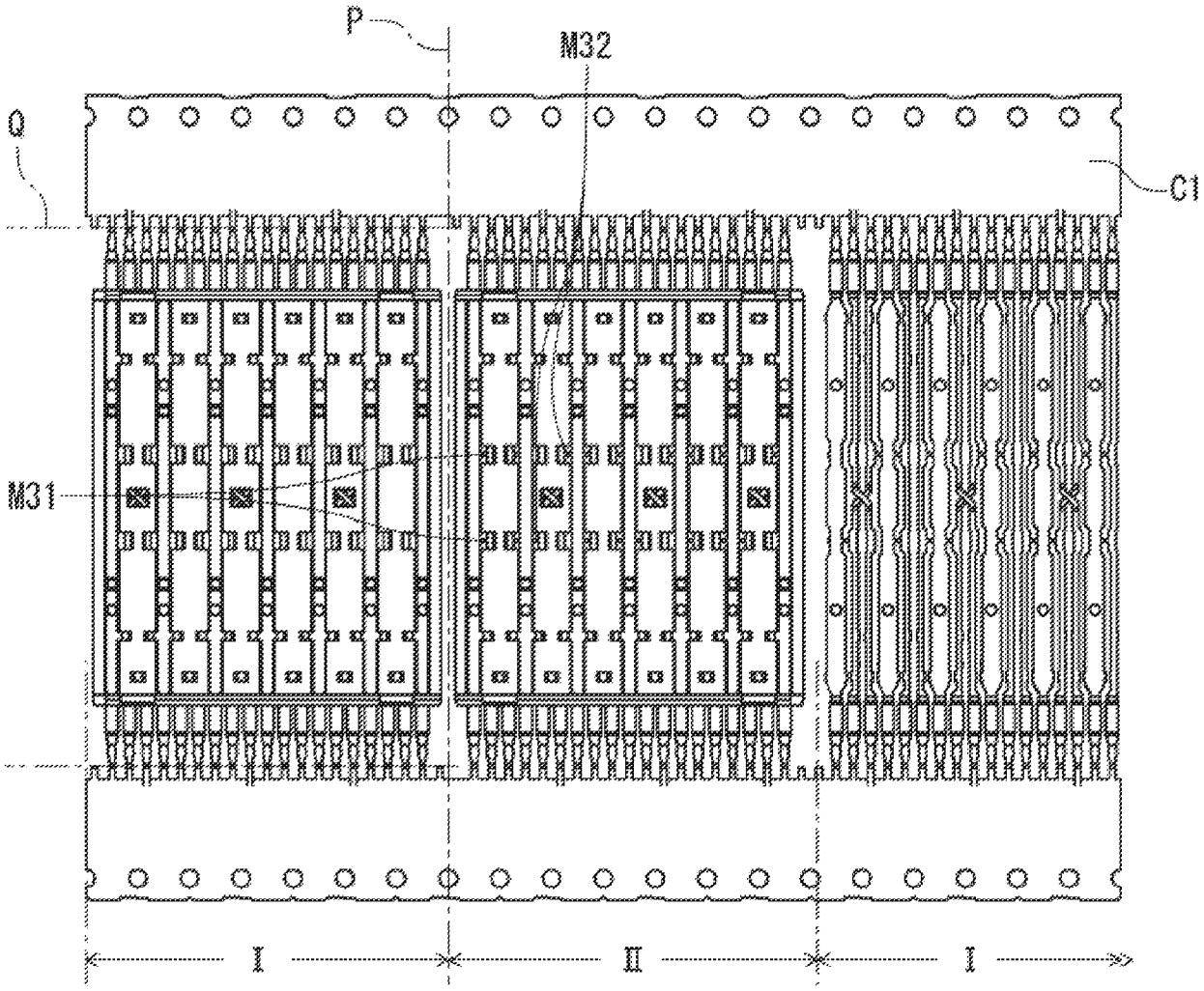
FIG. 7 is a front view showing a process of integral molding of the piece of FIG. 6 with an insulation board so as to obtain a connecting blade, wherein a left portions I and II show the state after the integral molding, and the right portion I shows the state before the integral molding.

(3) After that, intermittently put each section of the first material M, which is attached to the other grounding line material part N25, to a molding die, and then integrally mold in the die with resin. As a result, the connecting blade 20 is obtained while being supported by the carrier C1. FIG. 7 shows the state of the section I, which is on the left, and the section II, which is in the center, after the integral molding with the insulation board 21. The Section I on the right shows the state before the integral molding.

(4) Thereafter, in FIG. 7, cutting the carrier C1 at the cut line P between the segments I and II and cutting the carrier C1 at the cutting line Q, and further cutting all joining portions M31 and M21 to separate and disconnect the respective line materials, one complete connecting blade 20 is obtained.

From now on, a modification example of the embodiment will be described based on FIG. 8.

Figure 8:
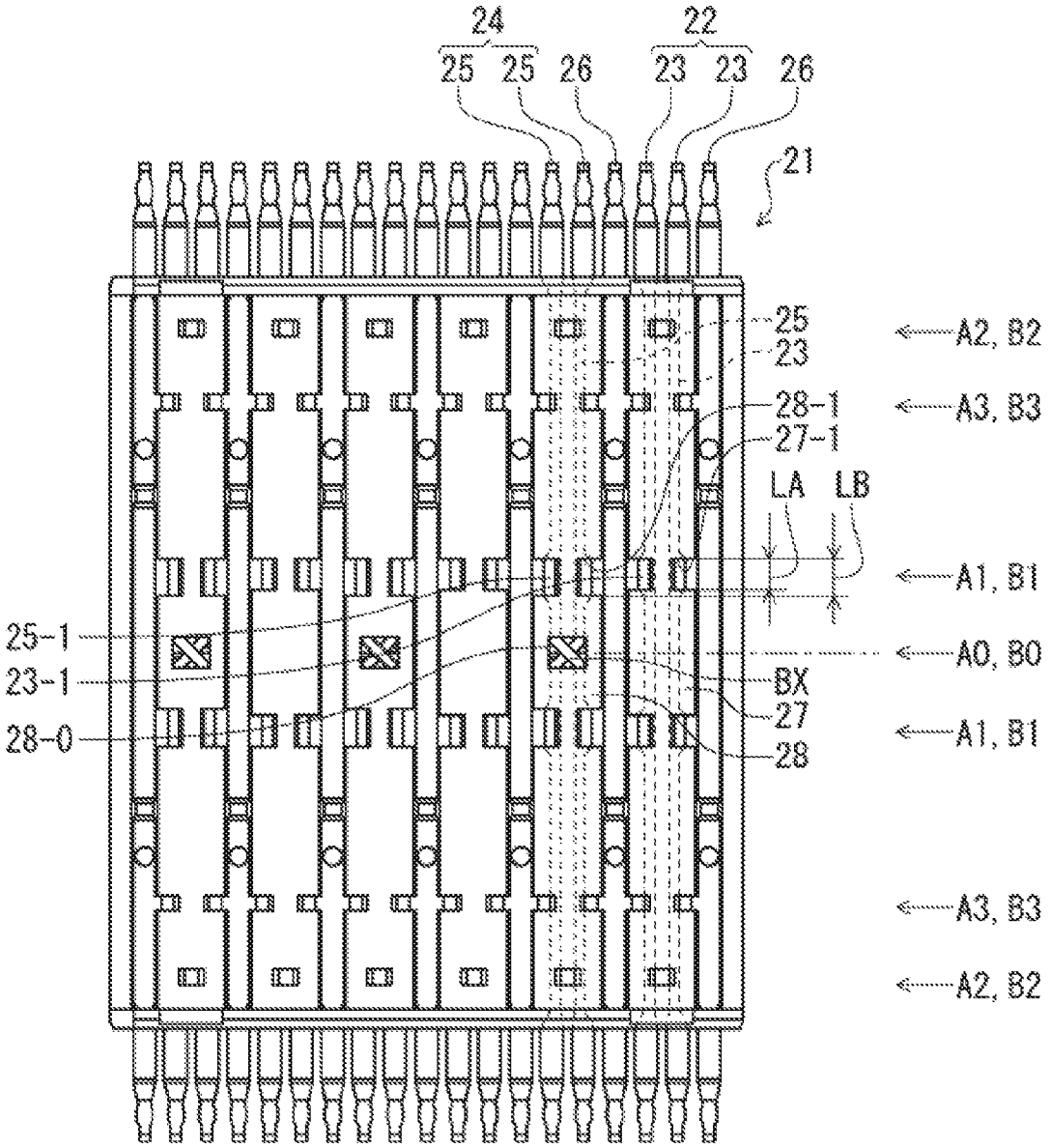
FIG. 8 is a front view showing a modification example of the connecting blade of the embodiment.

According to the example shown in FIG. 8, the lines 23 of the straight pair 22 and the embedding strips 27 of the insulation board 21, which cover the straight pairs 22, are the same as the straight pairs 22 and the embedding strips 27 shown in FIGS. 2(A), 2(B), and 2(C), respectively. On the other hand, the lines 25 of the cross pairs 24 and the embedding strips 28 of the insulation board 21, which cover the cross pairs 24 are different from the cross pairs 24 and the embedding strips 28 shown in FIGS. 2(A), 2(B), and 2(C), at the positions B1 in the longitudinal direction.

In case of the cross pairs 24, the long notches 28-1 formed on the embedding strips 28 at the positions B1 have length LB, which is longer than the length LA of the corresponding notches 27-1 formed on the straight pairs 22 in the longitudinal direction.

Corresponding to this, the wide portions 25-1 at the positions B1 of the cross pairs 24 are formed longer than the wide portions 23-1 of the corresponding straight pairs 22. Therefore, the notches 28-1 of the cross pairs 24 can work as additional adjustment regions in addition to the adjustment regions 28-0 as window-like portions for the amount of being longer than the notches 27-1 in the straight pairs, i.e. for the amount of the difference (LB-LA).

In this modification example, it is important to provide the additional adjustment regions formed by the notches 28-1 as necessary. The wide portions 25-1 of the lines 25 of the cross pairs 24 can have the same length as that of the wide portions 23-1 of the lines 23 of the straight pairs 22.

Figure 9:
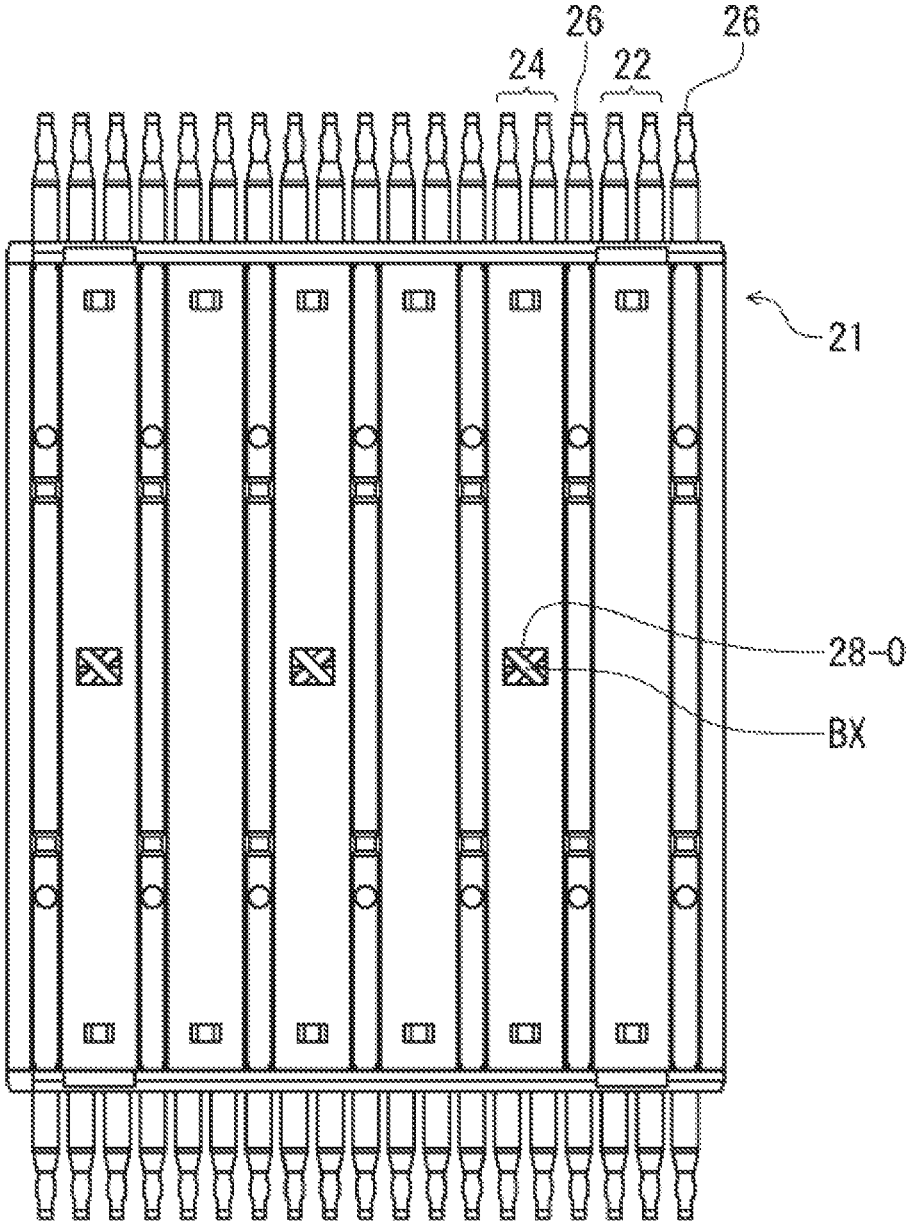
FIG. 9 is a front view showing another modification example of the connecting blade of the embodiment.

In addition, according to the embodiment, as a further modification example, as shown in FIG. 9, it is possible not to provide the notches on the embedding strips 27 of the insulation board 21 for the straight pairs 21 and the embedding strips 21 of the insulation board 21 for the cross pairs 24 as shown in FIG. 2(C) or FIG. 8.

Upon integral molding with the insulation board 21, as long as the pressing part of the die for the integral molding can sufficiently press the lines 23 of the straight pairs 22 and the lines 25 of the cross pairs 24 at the window-like portions 27-2 and 28-2 at the contact points 23A and 25B and the positions A2 and B2 and those positions will not displace by flowing of resin into the die, the notches are not necessary, and the embodiment shown in FIG. 9 is achievable. In this case, the adjustment regions of the insulation board 21 in the cross pairs 24 are adjusted and defined exclusively by the size of the window-like portions 28-0 at the center positions B-0. At this point, the window-like portions and the notches can be filled with an insulating material having lower permittivity than that of the insulation board.

According to the embodiment, a case, in which two circuit connecting members to be connected by the lines of the connecting blades are connectors, is described. Alternatively, at least one of the two circuit connecting members can be, for example, a circuit board. In this case, in the lines of the connecting blades, the contact points formed at the side to be connected to the circuit board will be connected to a corresponding circuit portion of the circuit board by soldering.

What is claimed is:

1. A connecting blade comprising:

an insulation board having a first adjustment region and a second adjustment region; and paired differential lines disposed on the insulation board, each of said paired differential lines having contact points at both ends thereof for connecting to a circuit connecting member, wherein said paired differential lines include a straight pair and a cross pair, said straight pair is formed of two first lines not crossing each other, said cross pair is formed of two second lines having a crossing region where the two second lines cross each other without contacting with each other and a parallel region where the two second lines extend in parallel, said cross pair is arranged so that the crossing region is situated to face the first adjustment region and the parallel region is situated to face the second adjustment region, and each of said first adjustment region and said second adjustment region has a specific size and a permittivity so that a signal transmission time lag between the cross pair and the straight pair is reduced.

2. The connecting blade according to claim 1, wherein said insulation board has the adjustment region first adjustment region and the second adjustment region formed of a recess portion or a hole portion, and said recess portion or said hole portion includes an air layer.

3. The connecting blade according to claim 1, wherein said cross pair is arranged so that the crossing region is situated adjacent to the first adjustment region.

4. An electrical connector comprising:

a housing to be connected to a mating connector; and the connecting blade according to the claim 1 and held with the housing, wherein said housing includes an opening portion at a location where the contact points are situated so that the contact points are connected to the mating connector when the housing is connected to the mating connector.

5. The connecting blade according to claim 1, wherein each of said two second lines has a wide portion in the parallel region.

6. A method of producing a connecting blade, said connecting blade comprising an insulation board having an adjustment region; and paired differential lines disposed on the insulation board, each of said paired differential lines having contact points at both ends thereof for connecting to a circuit connecting member, said paired differential lines including a straight pair and a cross pair, said straight pairs being formed of two first lines not crossing each other, said cross pair being formed of two second lines having a crossing region where the two second lines cross each other without contacting with each other, said method comprising the steps of:

preparing a first material including a first carrier on which the two first lines and one of the two second lines are disposed;

preparing a second material including a second carrier on which the other of the two second lines is disposed;

separating the other of the two second lines of the second material from the second carrier;

attaching the other of the two second lines to the first carrier at a specific location so that the other of the two second lines and the one of the two second lines form a crossing region;

forming an insulation board integrally with the two first lines and the one of the two second lines through an integrated molding so that the insulation board has the adjustment region facing at least a portion of the cross pair; and removing the first carrier.

7. The method of producing the connecting blade according to claim 6, wherein, in the step of forming the insulation board through the integrated molding, said insulation board is formed to have the adjustment region formed of a recess portion or a hole portion so that the recess portion or the hole portion includes an air layer after a mold is removed.

* * * * *